US008023884B2

(12) United States Patent
Howarter et al.

(10) Patent No.: US 8,023,884 B2
(45) Date of Patent: Sep. 20, 2011

(54) SYSTEM AND METHOD FOR RADIO FREQUENCY AUDIO RECORDER

(75) Inventors: Jamie Christopher Howarter, Overland Park, KS (US); Douglas Bruce Ceballos, Olathe, KS (US); Richard G. Bradford, Kansas City, MO (US)

(73) Assignee: Embarq Holdings Company, LLC, Overland Park, KS (US)

( * ) Notice: Subject to any disclaimer, the term of this patent is extended or adjusted under 35 U.S.C. 154(b) by 735 days.

(21) Appl. No.: 12/059,792

(22) Filed: Mar. 31, 2008

(65) Prior Publication Data

US 2009/0258593 A1 Oct. 15, 2009

(51) Int. Cl.
*H04H 20/71* (2008.01)
*H04K 3/00* (2006.01)

(52) U.S. Cl. ..... 455/3.03; 725/86; 725/105

(58) Field of Classification Search ..... 455/3.03–3.05; 725/62–66, 86, 105
See application file for complete search history.

(56) References Cited

U.S. PATENT DOCUMENTS

2002/0025777 A1* 2/2002 Kawamata et al. ..... 455/3.05
* cited by examiner

*Primary Examiner* — Lee Nguyen
(74) *Attorney, Agent, or Firm* — SNR Denton US LLP

(57) ABSTRACT

A user is provided with the ability to request the re-transmission of a content selection that is determined to not be locally stored, while the same content is currently being broadcasted. A system and method for replaying content is provided, where a receiver (e.g., car radio) initially receives a command from a user to replay a content selection. A determination may be made as to whether the content selection is locally stored. If it is determined that the content selection is not locally stored, a request is re-communicated for the content selection to be communicated from a service provider. The requested content selection may be received and/or played.

16 Claims, 5 Drawing Sheets

800

SYSTEM AND METHOD FOR RADIO FREQUENCY AUDIO RECORDER

BACKGROUND OF THE INVENTION

There have been many changes in the radio industry over the last decade. Traditional analog terrestrial radio is no longer the exclusive provider of audio content to listeners. Digital audio communications, in a variety of forms, are becoming increasingly prevalent. Digital content (audio or otherwise) can be communicated in several different ways. Some common examples of communicating digital content include over the Internet, over the air through the use of satellites, or over the air through terrestrial means using appropriate transmitters.

One increasingly popular means for providing digital content is through satellite radio. Satellite radio has become widely used in the past decade. At this time, there are two main providers in the United States—XM and Sirius. These providers operate on a subscription (fee-based) basis and require listeners to use receivers with unique identification numbers to determine subscriber information. Because satellite radio in the United States operates on a subscription basis, the subscriber information is necessary for use in decoding the digital transmission received over the satellite broadcast. In addition to audio content that includes, but is not limited to, music, weather, sports, talk, and news, satellite providers are able to provide real-time traffic and weather information in both audio and non-audio form (e.g., text). More recently, Sirius and XM have begun to provide video content, as well, for providing television service to their subscribers.

The advent of HD Radio™ now provides for even more digital options. HD Radio™ is a predominately fee-free terrestrial alternative for providing digital content, which has been gaining ground in the past several years. Initially HD Radio™ stood for Hybrid Digital radio, based on the mode originally used for broadcasting. Today, however, HD Radio™ is a trademark of the iBiquity Digital Corporation. HD Radio™ uses an in-band on-channel (IBOC) technology that was selected by the Federal Communications Commission (FCC) in 2002 for terrestrial digital audio broadcasting in the United States. The specifications for the IBOC standard as used by HD Radio™ provides for both an "All Digital" and a "Hybrid Digital" operating modes. The hybrid mode of HD Radio™ operates in a similar manner as traditional analog stations, except that a digital data stream is transmitted in addition to the analog waveform signals. Currently, most stations offering HD Radio™ are using the hybrid mode. In the future, it is expected that an all digital signal will be more common. Multicasting, or providing more than one program over an existing spectrum, allows for more choices of content for users. However, similar to satellite radio, additional equipment must be purchased by users to receive HD Radio™. That is, an HD Radio™ receiver must be acquired that is capable of receiving multicast channels.

Regardless of the type of content delivery, a user may desire to listen to a song or program from the beginning, although the radio was not actively receiving the signal when the song or program initially began, as in the case of a user turning on the radio or switching channels in the middle of the song or program. In such circumstances where the user desires to hear the entire song or program, the user is simply "out-of-luck" with conventional radio equipment.

SUMMARY

To overcome the problem of conventional radio equipment from not enabling a user to play more content (e.g., song or program) then when received, the user switches to a radio channel or turns the radio on during a content being broadcast, the principles of the present invention provide for requesting more content from a network source of the content being broadcasted, if not locally available in cache or other memory. The more content may include all or a portion of the content. For example, if a user switches radio channels during a song, the user may request the entire song via a user interface and the entire song may be downloaded. Alternatively, if the user turns on a radio channel during a third hour of a talk show, the user may request to download the second and third hours.

One embodiment includes a system and method for replaying content. In this embodiment, a receiver initially receives a command from a user to replay a content selection currently being broadcast. A determination may be made as to whether the content selection is locally stored. If it is determined that the content selection is not locally stored, a request is communicated for the content selection to be communicated from a service provider. The requested content selection may be received and played.

Another embodiment includes a method for transmitting content. In this embodiment, a request is received by a service provider for a content selection currently being broadcast to be communicated to a remote device. The requested content selection may be communicated to the remote device.

BRIEF DESCRIPTION OF THE DRAWINGS

Illustrative embodiments of the present invention are described in detail below with reference to the attached drawing figures, which are incorporated by reference herein and wherein.

DETAILED DESCRIPTION OF THE DRAWINGS

Figure 1:
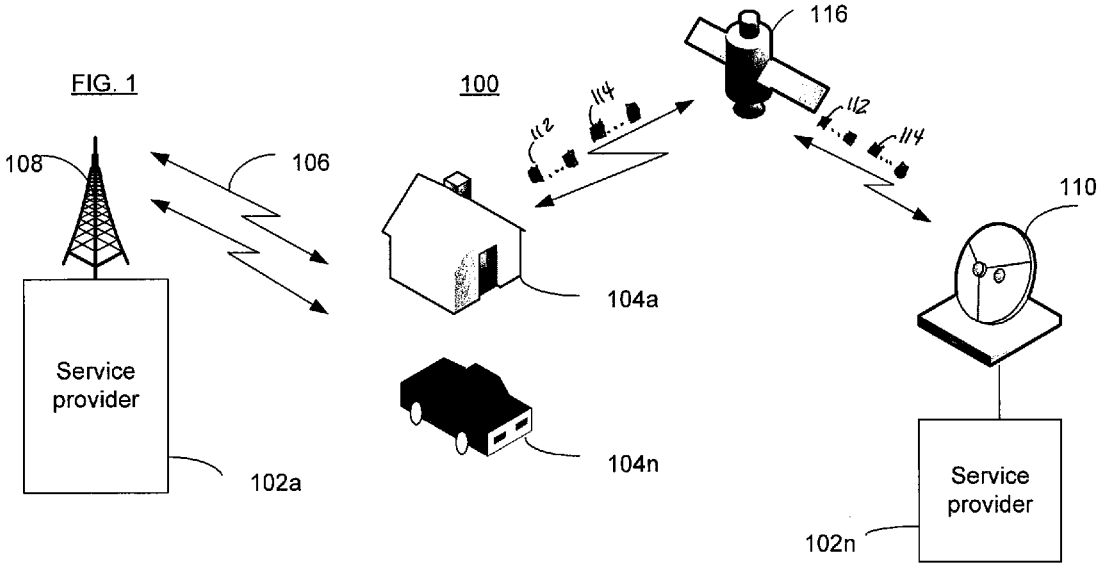
FIG. 1 is an illustration of exemplary radio broadcast networks for communicating digital content to a user.

FIG. 1 is an illustration of exemplary radio broadcast networks 100 for communicating digital content. Content may be communicated between service providers 102*a*-102*n* (collectively 102) and users 104*a*-104*n* (collectively 104). Service providers 102 may include traditional radio stations, satellite radio providers, Internet service providers, any affiliate thereof, or any type of broadcaster capable of distributing digital content to users 104. Alternatively, the service providers 102 may by any type of broadcaster capable of distributing analog content, as well. The users 104 may be located in a variety of locations to receive the digital content from the service providers 102, including a stationary location, such as a home or office, or in a mobile location, such as in a vehicle, airplane, or train.

In one embodiment, data signals 106, such as HD Radio™, may be transmitted over an antenna 108. The data signals 106 may include data packets (not shown) that are broadcast to digital receivers of users 104 in a local area around the antenna 108. In another embodiment, a satellite dish antenna 110 may be used for communicating data packets 112 to the users 104, as well as data packets 114 from the users 104 via a satellite 116 orbiting above the Earth. The satellite 116 operates as a repeater to receive and communicate the data packets 112 and 114 between the service provider 102*n* and users 104. Satellite communications provides for a communication link over huge expanses of area.

As previously described, the data packets 112 and 114 are capable of carrying bi-directional information between both the service providers 102 and the users 104. Using codes located in the data packets 112 and 114, content may be sent from the service providers 102 to specific users 104, as well as commands may be sent from the users 104 to the service providers 102 to request a user specified quantity of content (e.g., entire song or portion of programs) to be rebroadcast to a user 104. The codes and data packets are described in greater detail with regard to FIGS. 6 and 7.

Figure 2:
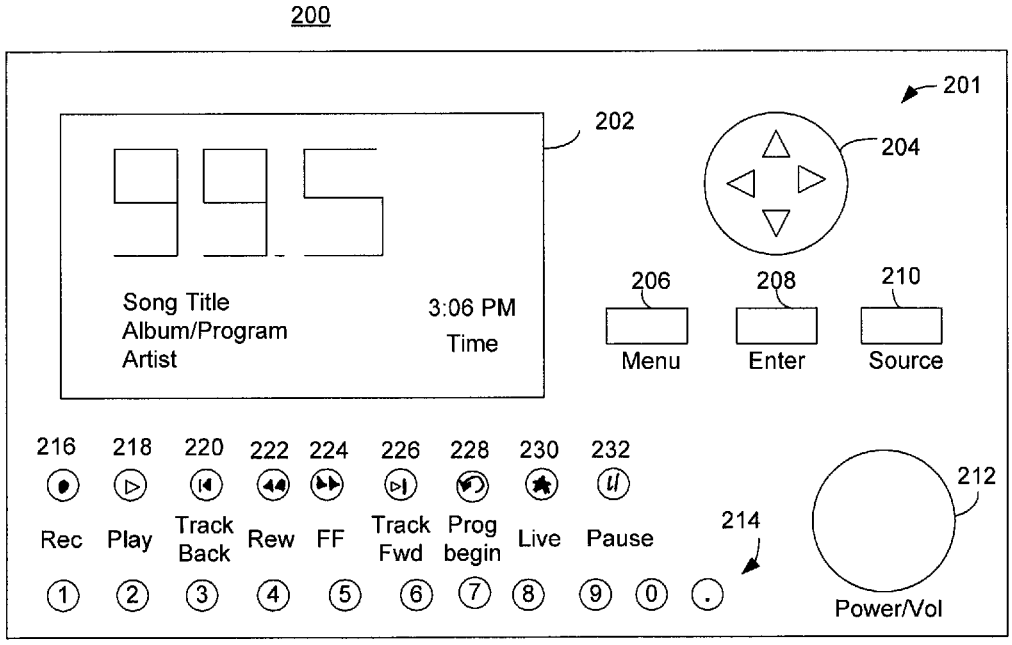
FIG. 2 is an illustration of an exemplary receiver capable of performing the principles of the present invention.

FIG. 2 is an exemplary embodiment of a receiver 200 capable of performing the principles of the present invention. The receiver 200 may include a user interface 201 that includes a screen 202 for displaying useful information related to the content. Some information that may be displayed may include a station number or frequency, song title, album name, program name, artist, length of time remaining, length of time elapsed, among numerous other useful and relevant data. The screen 202 may be an LCD, LED, or any other type of screen capable of displaying content information. A button 204 for control of a menu displayed on the screen 202 may also be provided. The button 204 may be any type of input device for controlling the receiver, not limited to any particular shape, material, or functional structure. Other inputs may include a menu button 206 for requesting a menu screen to be displayed on the screen 202. The menu (not shown) may include an option for the user to select a time frame for receiving content not locally available, such as a set amount of time of the previously broadcast content, a set number of previous songs, or to the beginning of a program, among many other options. An enter button 208 may be utilized by a user to select items on the menu screen. Similarly, a source button 210 may be utilized by the user to select a source (e.g., AM, FM, CD, satellite, memory, HD Radio) from which the receiver 200 is to receive content.

The remaining buttons 212-232 depicted in FIG. 2 have their customary meanings with a few exceptions to enable a user to request and record selected portions of, or entire content, even if the requested content was not originally received from the start of the content being broadcast. A combination power and volume button 212 may be provided for turning on the device as well as controlling the volume of the content. The buttons collectively labeled 214 may allow for direct station selection, as well as any other type of input where a numeric value may be used on the receiver 200. A record button 216 may alternatively be used to signal the receiver 200 to begin recording the content currently being broadcast to the receiver 200. The record button 216 may alternative be used to initiate a record menu on the screen 202 that could allow the user to record a specific duration of content or for any number of other recording options. In one embodiment, the record button 216 may be pre-programmed by a user to record in a desired manner (e.g., from the instant point in time forward, from the start of the content, from the top of the hour, etc.). Other traditionally functioning buttons include play 218, track back 220, rewind 222, fast forward 224, track forward 226, and pause 232. While a traditional receiver may use these buttons to control a CD or other media, the principles of the present invention allow for these functions to be used to play recorded content as well.

An additional function provided by principles of the present invention may include a program begin button 228. The program begin button 228 may allow a user to request the content that is currently being broadcast from a service provider to be played from the beginning of the content. The program begin button 228 may be a "shortcut" for requesting the content to be retransmitted in the event that an amount of the content selected is not locally available at the receiver 200 for replay. An example amount of content may be set to default to the beginning of a song, or any other period of time or setting as the user desires. The functions of determining whether the amount of content selected is locally available and requesting retransmission are described below in further detail. A live button 230 may enable a user to selectively return to broadcast content from recorded content. The term broadcast as used in the context of this application means non-user selectable content that is transmitted from a source to any device capable of receiving the content. In other words, the broadcast content is not specifically sent to a unique user upon request, as is pay-per-view content or other user-selectable content. Broadcast, additionally, refers to content that is being transmitted from a source in real-time. Real-time content, in this sense, is to be distinguished from the content selected by the user to be retransmitted. The content may be live, delayed, or pre-recorded. The described features and functionalities are exemplary in nature and need not all be present for implementation.

Figure 3:
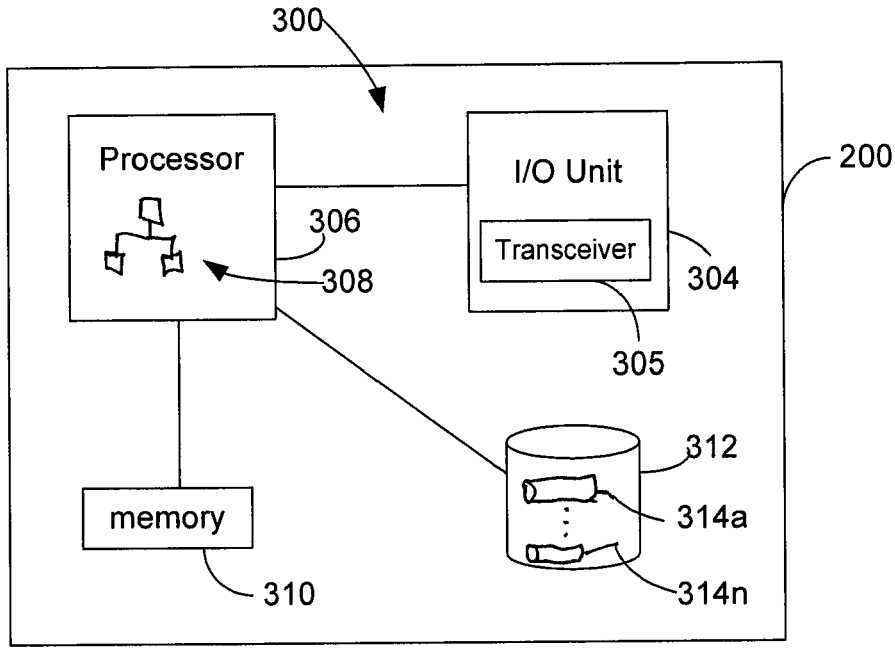
FIG. 3 is a block diagram of exemplary components of a receiver configured to facilitate storing and replaying digital content.

FIG. 3 is a block diagram of exemplary components 300 of the receiver 200 (FIG. 2) configured to facilitate requesting, storing, and replaying of digital content. The receiver 200 may include an input/output (I/O) unit 304 for communicating commands and receiving content. The I/O unit 304 may additionally include a transceiver 305 for transmitting requests for content and for receiving the content. The transceiver 305 may be located anywhere within the receiver 200, and should not be construed as necessarily being located within the I/O unit 304. The receiver 200 may also include a processor 306 for processing the commands and content. The processor 306 may execute software 308 capable of performing the functionality of the receiver 308, as described in FIG. 2. Memory 310 may also be located within the receiver 200 for storing data being processed by the processor 306. A storage unit 312 may also be included in the receiver 200. The storage unit 312 may be a hard drive or any other type of volatile or non-volatile memory capable of storing data. Within the storage unit 312 may be one or more data repositories 314*a*-314*n*, such as a data base, or multiple databases 314*n* capable of storing and organizing data, such as content. In one embodiment, rather than including a storage unit 312, the receiver 200 may use a memory 310 that is large enough to store sufficient content for a user's typical use.

Figure 4:
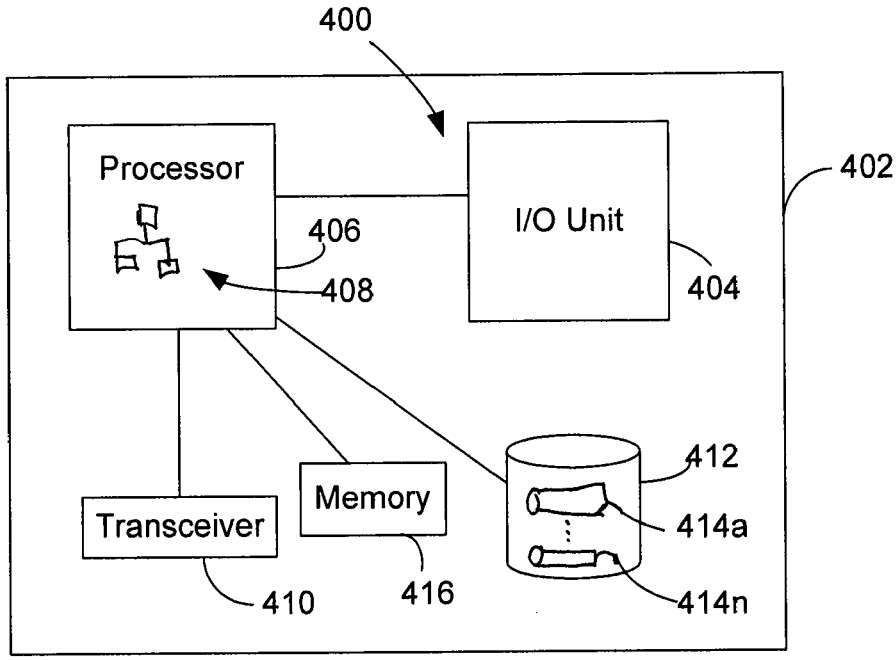
FIG. 4 is a block diagram of exemplary components of a network server configured to facilitate the transmission of audio content to users.

FIG. 4 is a block diagram of exemplary components 400 of a network server 402 configured to facilitate the transmission of digital content to users. The network server 402 may be located anywhere on a network that is capable of communicating data to a user. Some examples of a network server 402 may be located as part of a satellite radio service provider, radio station, or any other content provider. The network server 402 may include an input/output (I/O) unit 404 for receiving commands and transmitting content. The network server 402 may also include a processor 406 for processing the content. The processor 406 may execute software 408 capable of communicating with receivers, processing commands, and distributing content, among other functioning. A transceiver 410 may be in communication with the processor 406 and, optionally, the I/O unit 404 for transmitting content to a user and receiving commands from a user.

In one embodiment, the transceiver is configured to transmit content selected by a user for retransmission on a different frequency or using a different channel code in a data packet, as in the case of using code division multiplexing (CDM) of a data stream. A storage unit 412 may also be included in the network server 402. The storage unit 412 may be a hard drive or any other type of volatile or non-volatile memory capable of storing data. Within the data repository 412 may be one or more databases 414*a*-414*n* capable of storing and organizing data, such as content. In one embodiment, rather than including a storage unit 412, the network server 402 may use a memory 416 that is large enough to store sufficient content for a service provider's typical use. The memory 416 may also be located within the network server 402 for storing data being processed by the processor 406.

Figure 5A:
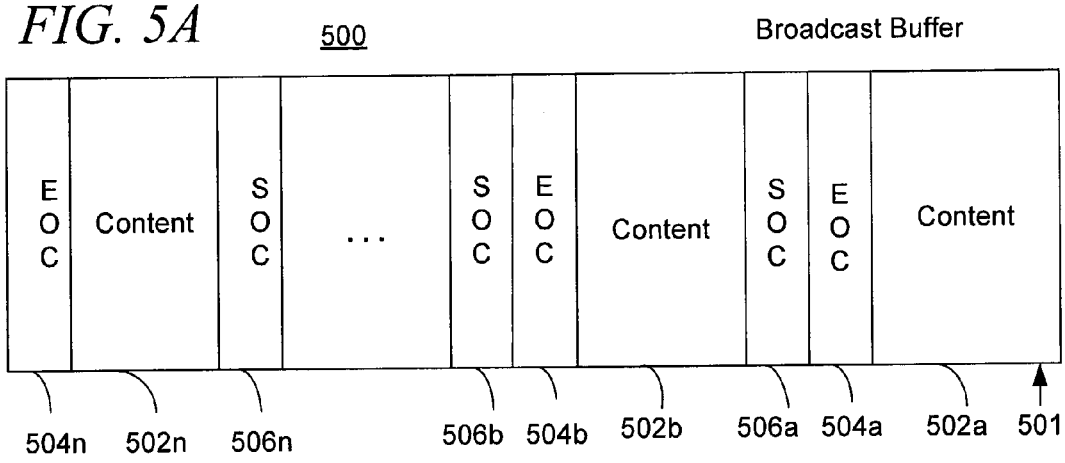
FIG. 5A is a diagram of an exemplary broadcast data buffer in a receiver for storing broadcast content.

FIG. 5A is a diagram of a broadcast data buffer 500 configured to store broadcast content in a receiver, such as receiver 200 of FIG. 2. The broadcast data buffer 500 may be analogous to cache memory. The broadcast data may be content data that is communicated or broadcast real-time by a service provider. The broadcast data buffer 500 is typically processed from right to left, using a pointer 501 (i.e., memory element storing an address in memory to which the memory element currently refers) to read through content contained within the broadcast data buffer 500. A typical length of the broadcast data buffer 500 may be 10 minutes or longer depending upon various storage constraints.

In FIG. 5A, content 502*a* is depicted first, followed by an end of content (EOC) marker 504*a*. Because there is no start of content (SOC) marker prior to content 502*a* in the broadcast data buffer 500, the receiver is able to recognize that content 502*a* is not a complete content (e.g., an entire song is not stored in the broadcast data buffer 500). For a complete content copy to be recognized by a receiver, a pair of markers SOC and EOC is to "sandwich" the content. Following EOC marker 504*a* for content 502*a*, SOC marker 506*a* for content 502*b* is positioned. SOC marker 506*a* is an indication that content 502*b* follows. After content 502*b*, EOC marker 504*b* is located in the broadcast data buffer 500. The pair of SOC and EOC markers 506*a* and 504*b* may be interpreted by the receiver as a complete content. In other words, if the data pointer 501, which represents the location in the buffer where the user is currently listening, is within content 502*b*, a determination may be made that the complete content 502*b* is available based on having both the SOC marker 506*a* and EOC marker 504*b* present. If the data pointer 501 was currently located within content 502*a*, a determination may be made that the complete content, or portion of content that the user selects, is not buffered and a request to have content 502*a* retransmitted may be performed by the receiver.

Figure 5B:
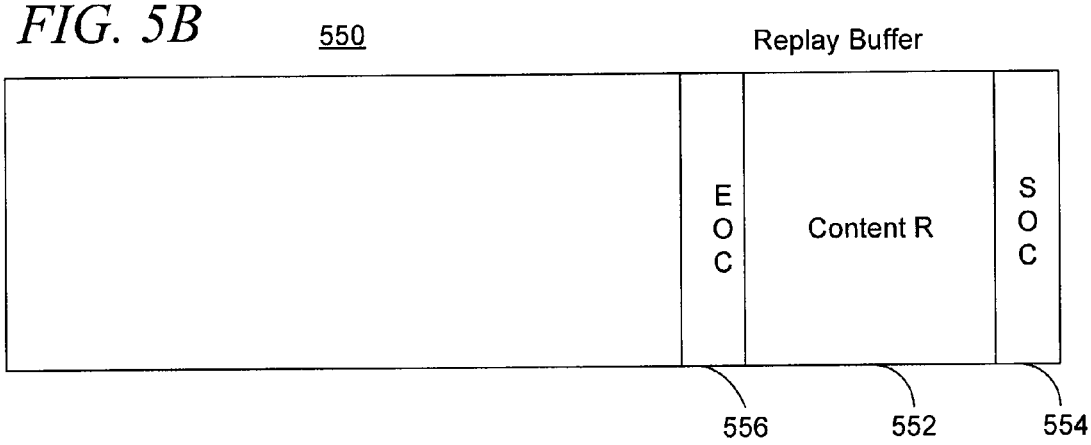
FIG. 5B is a diagram of an exemplary replay data buffer in a receiver for storing replay content.

FIG. 5B is an exemplary diagram of a replay data buffer 550 for storing replay content. The replay data buffer 550 may be located within a receiver and may be used to store content 552 that has been requested to be replayed and/or retransmitted from service provider. A for a replay buffer may be configured to store an hour or more of content, with the buffer may be as large as the largest user selectable option for prior content. The replay data buffer 550 may be populated with content in response to the user pressing the record button 216 (FIG. 2) on the receiver or through a menu option as previously described. Similar to the broadcast data buffer 500, the SOC marker 554 and EOC marker 556 may be stored to indicate the start and end of the content 552 respectively. It should be understood that other markers, such as start of hour (SOH), may be utilized for defining certain time periods. It should be understood that the broadcast data buffer 500 and replay data buffer 550 may operate in parallel in the same or different memory devices by one or more processors. For example, the user may play content stored in replay data buffer 550 while broadcast content is buffering (i.e., being stored) in broadcast data buffer 500. Parallel operation of the buffers 500 and 550 provides a user more flexibility in operating the receiver.

Figure 6:
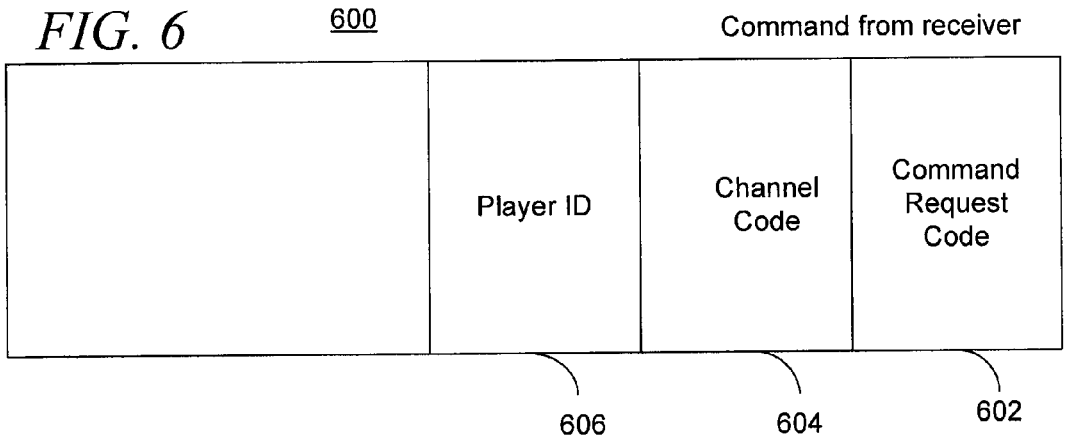
FIG. 6 is a depiction of an exemplary command data packet for communicating a command to a service provider.

FIG. 6 is a depiction of an exemplary command data packet 600 for communicating a command or request to a service provider. Several different commands may be transmitted from a user to a service provider in one or more command data packets. The command data packet 600 may contain a command request code 602, which is able to be interpreted by the service provider. The command request code 602 may include one or more commands to retransmit content, retransmit a specific length of time (e.g., from head of the hour), retransmit from the beginning of a program, retransmit from the beginning of a song, or any other type of command to which the service provider is capable of interpreting and responding. The command request code 602 may be any alphanumeric value that the service provider and receiver are capable of interpreting. For example, a command request code may be "RE0941," which represents rebroadcast entire content currently being broadcasted at time 9:41 AM. A channel code 604 may also be included in the data packet 600. The channel code 604 may be a code that identifies a channel on which content is being broadcast that the user has selected, such as "CH52" (i.e., channel 52). A player ID code 606 may also be provided that would notify the service provider which user is to receive the retransmitted content so that a player ID or user ID may be communicated with the retransmitted content, thereby notifying the user's receiver to store the content in a replay buffer and other receivers to ignore the retransmission. The player ID code 606 may be a unique code (e.g., XM1724935) for each receiver. It should be understood that the codes 602 and 604 and player ID in the command data packet 600 are exemplary and that different or additional command information may be communicated from the user to the service provider may be utilized to cause more content than locally available in a cache or other memory to be retransmitted.

Figure 7:
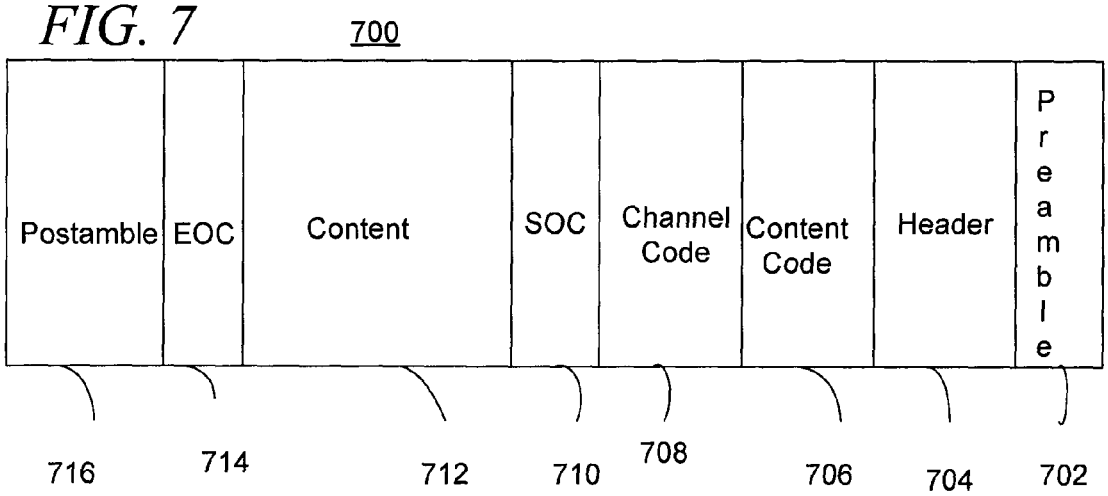
FIG. 7 is a depiction of an exemplary data packet for communicating digital content.

FIG. 7 is a depiction of an exemplary data packet 700 for communicating content. The data packet 700 may be sent in response to receiving a command data packet 600 including a command to a service provider or may be sent as part of a regular broadcast data stream. A preamble 702 may be part of the data packet 700 to signal the beginning of transmission and enable a receiver to synchronize on the data packet 700. A header 704 may also be present in the data packet 700 that contains information that may include station information, song information, or other content or non-content information, such as player ID. A content code field 706, which may alternatively be part of the header, may indicate what type of content and how much content is being retransmitted. Some examples of types of content are audio, video, text or some other type of content. A channel code 708 may be included. SOC marker 710, content 712, and EOC marker 714 are as described in FIG. 5A for the broadcast data buffer 500. A post-amble 716 may include data that represents the end of the data packet 700, and allow for the receiver to know when the entire transmission of the data packet 700 has been completed.

Figure 8:
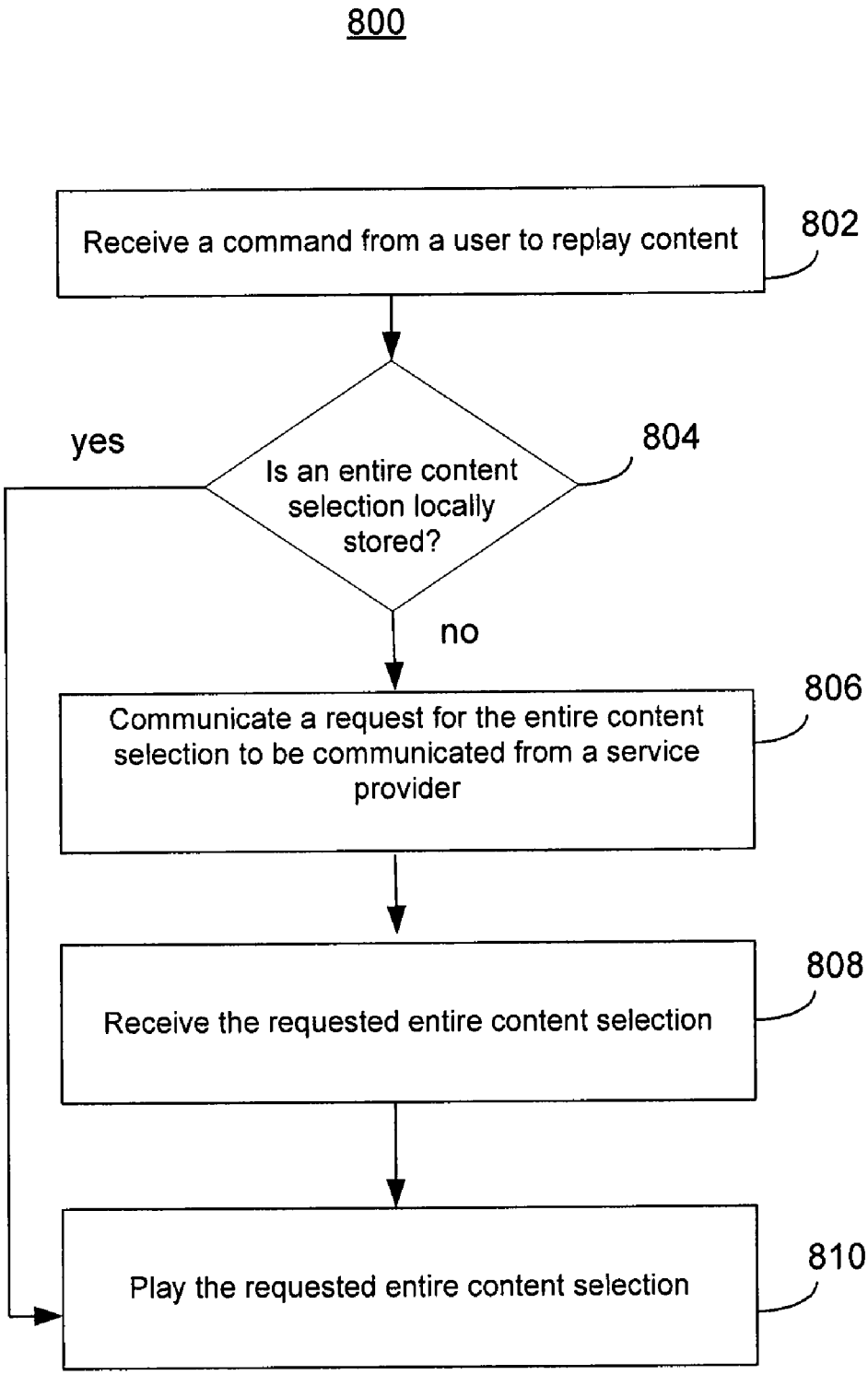
FIG. 8 is a flow diagram of an exemplary process of replaying digital content.

FIG. 8 is a flow diagram of an exemplary process 800 of replaying content being broadcast. A command may be received from a user to replay selected content at step 802. An inquiry may then be made to determine if the selected content is stored locally at step 804. The selected content may be a song, program, television show, movie, or any other type of content capable of being transmitted from the service provider. The selected content may also be a portion of a show, song, program, etc. For example, if a user began listening to a three hour long program during the third hour, but wanted to hear back to the beginning of the second hour, the user would be able to request a specified length of time or start from a certain time via a menu or other mechanism or a user interface on a receiver.

If the selected content is not stored locally, a request for the selected content to be communicated from a service provider may be communicated to the service provider in step 806. The selected content may be received at step 808. At step 810, whether the requested selected content was initially stored locally or not, the selected content may then be played.

Although described with respect to a radio receiver, the principles of the present invention provide for use with other broadcast media, including television and the Internet, for communicating television shows, movies, or other content Devices, such as digital video recorders, may be configured to utilize the same or analogous functionality as described herein.

The previous detailed description is of a small number of embodiments for implementing the invention and is not intended to be limiting in scope. The following claims set forth a number of the embodiments of the invention disclosed with greater particularity.

What is claimed:

1. A method for replaying content, said method comprising:

receiving a command from a user interface to replay selected content currently being broadcasted;

determining if the selected content is locally stored;

generating a command request code to identify the selected content, wherein the command request code indicates a time and amount of selected content, communicating a request for the selected content to a service provider for the selected content to be communicated from the service provider in response to determining that the selected content is not locally stored, wherein the request for the selected content includes the command request code;

receiving the requested selected content;

receiving a content code indicating the content type and an amount of content to be replayed; and playing the selected content.

2. The method according to claim 1, wherein communicating a request for the selected content includes communicating the request for an entire song to be communicated.

3. The method according to claim 1, wherein communicating a request for the selected content to be communicated from the service provider includes communicating the request to a radio station operator.

4. The method according to claim 1, further comprising:

receiving a first portion of the content from a broadcast source at a first time, the first portion being received by a user;

manually initiating a request to replay content at a second time that is later than the first time in response to user input;

transmitting the request to replay selected content currently being broadcasted via a non-broadcast wireless communication at a third time that is later than the second time;

receiving a second portion of the content at a fourth time that is later than the third time, wherein the content comprises a song, wherein receiving the content code indicates to replay a single song, and wherein the single song comprises the second portion of the content followed by the first portion of the content; and replaying the single song at a fifth time that is later than the fourth time.

5. The method of claim 4, further comprising:

receiving a start of content marker;

receiving an end of content marker; and replaying the content from the start of content marker to the end of content marker.

6. The method according to claim 1, further comprising simultaneously receiving real-time broadcast by one of using a channel code.

7. The method according to claim 1, further comprising storing the requested content selection to be replayed, separate from storage of the broadcasted content, in response to the content selection being received.

8. The method of claim 1 further comprising:

a user receiving a first portion of the content from a broadcast source at a first time;

the user manually initiating the command to replay selected content after receiving the first portion of the content;

transmitting the request to replay selected content currently being broadcasted via a satellite communication at a second time;

receiving a second portion of the content at a third time, wherein the selected content comprises the second portion of the content followed by the first portion of the content;

receiving a start of content hour marker that corresponds to the start of the second portion of the content; and replaying the content from the start of hour marker.

9. A system for replaying content, said system comprising:

a processor configured to:

receive a command from a user to replay content, wherein the command from a user to replay the content comprises a command request code indicating a time and an amount of content to be replayed;

determine if selected content is locally stored;

communicate a request for the selected content to be recommunicated from a service provider in response to determining that the selected content is not locally stored;

receive the requested selected content;

receive a content code indicating the content type and an amount of content to be replayed; and play the selected content.

10. The system according to claim 9, wherein the service provider is a radio station operator.

11. The system according to claim 9, wherein said processor, in determining whether the selected content is locally stored, determines whether the selected content is stored in cache memory.

12. The system according to claim 11, wherein said processor, in determining whether the selected content is stored in cache memory, is further configured to determine if a start of content marker is available in the cache memory.

13. The system of claim 12, wherein the command request code corresponds to a specific point in time and indicates to replay, in its entirety, content that was provided to the system from the service provider at the specific point in time.

14. The system of claim 13, wherein the content comprises songs, and wherein the command request code indicates to replay a single song that was transmitted via broadcast from the service provider prior to the transmission of one or more subsequent songs to the remote device, wherein one of the subsequent songs is being received by the remote device at the time the command request code is generated.

15. The system according to claim 9, wherein the processor is further configured to store the requested content selection, separate from the content being broadcast.

16. The system of claim 9, wherein receiving a request from a remote device for selected content currently being broadcasted to be re-communicated to the remote device comprises receiving a user initiated request via satellite.

* * * * *